United States Patent [19]

Cooke

[11] Patent Number: 4,674,668

[45] Date of Patent: Jun. 23, 1987

[54] WIRE SUPPLY MONITOR

[76] Inventor: Mack A. Cooke, 910 Neal St., Greensboro, N.C. 27403

[21] Appl. No.: 760,785

[22] Filed: Jul. 31, 1985

[51] Int. Cl.[4] ..... B65H 23/04; B65H 23/02; H01H 27/04

[52] U.S. Cl. ..... 226/45; 200/61.18; 226/2; 226/11

[58] Field of Search ..... 226/2, 11, 45, 10, 43; 242/36, 57; 200/61.18

[56] References Cited

U.S. PATENT DOCUMENTS

| | | | |
|---|---|---|---|
| 2,419,518 | 4/1947 | Eichinger | 200/61.18 |
| 2,685,626 | 8/1954 | Zwack | 200/61.18 X |
| 2,966,291 | 12/1960 | Anderson | 226/11 |
| 3,227,833 | 1/1966 | Davies et al. | 200/61.18 X |
| 3,268,709 | 8/1966 | Olds | 226/11 |
| 3,391,840 | 7/1968 | King | 226/11 |

*Primary Examiner*—John M. Jillions
*Assistant Examiner*—Lynn M. Sohacki
*Attorney, Agent, or Firm*—Griffin, Branigan & Butler

[57] ABSTRACT

The present invention relates to a wire supply sensing apparatus (4) for monitoring the supply of wire (3) to a wire receiver (5) from a wire supply source (1). The sensing apparatus (4) is comprised of a tangled wire sensor (7) and a wire supply continuity sensor (9). The wire supply continuity sensor (9) has a sensing arm (23) which responds to the absence of wire due to wire breakage or depletion of the wire supply from the source (1). Upon wire breakage or depletion the sensing arm (23) controls an electric switch (27) which signals a controller (33) to turn off electric power at the wire receiving apparatus (5). The tangled wire sensor (9) has a plunger (13) including a tension sensing channel (15) for detecting a tangle (37) in the wire. Tension caused by the tangle (37) provides a force against the plunger (13) to move the plunger (13) to a position indicating the presence of a sensed tangle. In the sensed tangle position, the wire (3) moves a distance away from the switch (27) and, as a result, the sensing arm (23) of the wire continuity sensor (9) moves to a position indicative of wire supply interruption. Switch (27) then signals controller (33) to turn off the power to wire receiver (5).

9 Claims, 5 Drawing Figures

Fig. 2
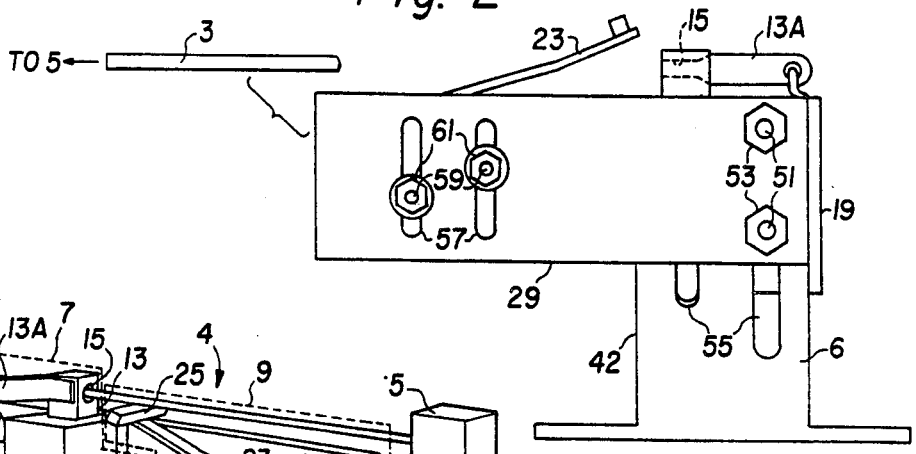
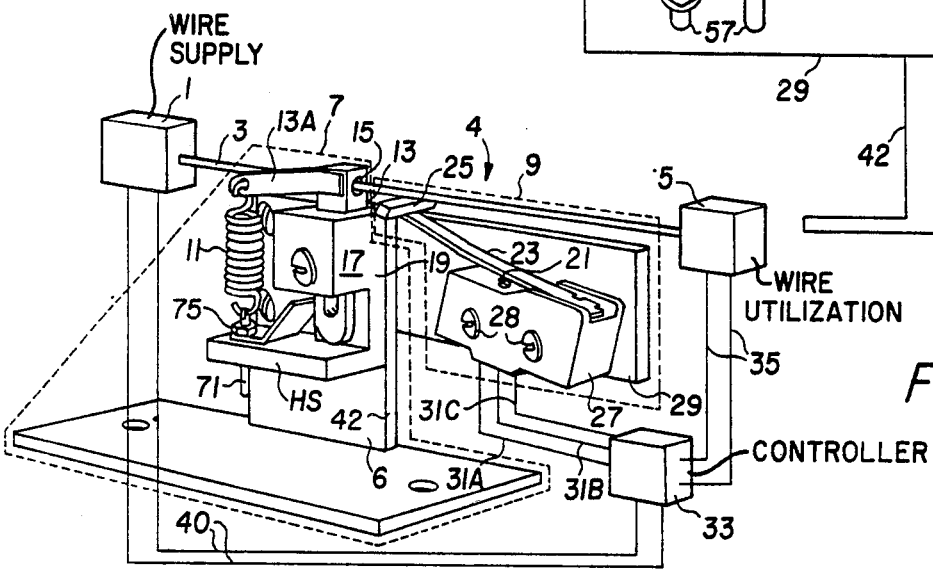
Fig. 1
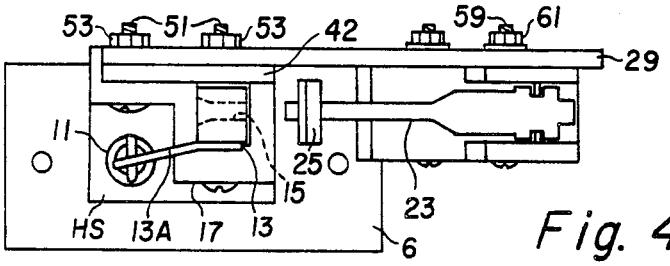
Fig. 4
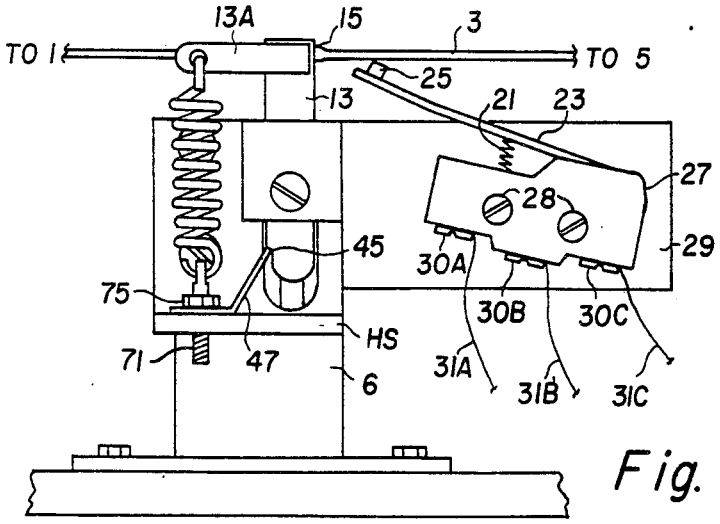
Fig. 3
Fig. 5
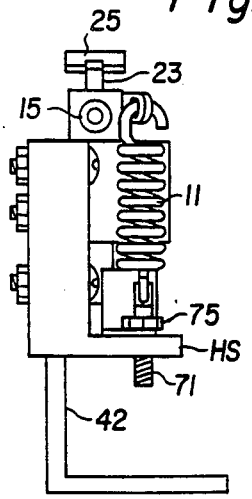

WIRE SUPPLY MONITOR

BACKGROUND OF THE INVENTION

I. Field of the Invention

The present invention relates to the field of electric arc welding in which a steady supply of welding wire is supplied to a contact electrode of an arc welding apparatus. More specifically, the invention relates to an apparatus for rapidly shutting off the electric power supplied to the welding contact electrode when the steady supply of welding wire is interrupted. The invention further concerns apparatus for sensing when the supply of welding wire is interrupted.

II. Prior Art and Other Considerations

In electric welding operations where a welding wire is supplied from a coil to welding contact electrode, a serious condition results when the supply of wire to the electrode is interrupted while the electrode is still receiving electric power. The electrode can be damaged from excessive heat when the wire is not present at the electrode unless the power to the electrode is turned off promptly.

There are basically three types of circumstances in which the steady supply of wire to the electrode is interrupted. In the first case, the wire on the supply coil or spool is simply exhausted. In the second case, the welding wire suffers a break between the supply coil and welding electrode. In the third case, a tangle or knot present in a spool of welding wire causes the supply of wire to the electrode to be interrupted.

In the prior art, several approaches have been proposed to solve some of the problems involved in the interruption of the steady supply of welding wire. In this regard, U.S. Pat. No. 3,268,709 to Olds discloses a control apparatus for interrupting electric power to an electric arc welder. The Olds device is comprised of a spring-biased plunger which moves in two opposite directions on a guide formed on two opposing inside walls of a housing. The plunger contacts one of two separate switches placed on opposing housing walls at opposite ends of the plunger. A first switch senses the absence of wire being fed to the control apparatus. A second switch senses a tangle in the wire being fed from the coil. The spring-loaded plunger is biased in a first direction, and the plunger moves in the direction of the spring bias in response to the condition of no wire being present at the plunger. The plunger receives the moving wire upon a grooved roller connected to the plunger, and the roller serves to guide the wire out of the control apparatus. A second grooved roller is placed on the control apparatus housing at the entrance of the wire to the apparatus. The roller on the housing and the roller on the plunger cooperate to guide the wire through the control apparatus when the wire moves freely without being tangled. When the wire is tangled, the force of the wire overcomes the biasing force and forces the plunger to the second direction to contact the second switch.

The Olds patent shows a cumbersome and complex device employing a plurality of rollers and a plurality of switches. In addition, in prior art devices such as those depicted by the Olds patent a tangled wire might temporarily turn off the signal to the welding arc, but there is no assurance that the signal would remain turned off until the tangle is rectified. Moreover, in a device such as Olds, a roll of wire having considerable slack would improperly cause the plunger to depress a switch and thereby needlessly turn off the power supply to the welding arc.

Accordingly, it is an object of the present invention to provide a simple apparatus that mechanically monitors the wire fed to an electric arc welding apparatus.

Another advantage of the present invention is the provision of a relatively simple wire monitoring apparatus which obviates the need of complex mechanical and electrical structure.

SUMMARY OF THE INVENTION

An improved welding wire monitoring apparatus is provided for bringing about the interruption of the electric current that flows to the contact electrode of an electric arc welding apparatus. The novel apparatus includes a novel sensing apparatus which is placed between the wire supply and the welding electrodes and which senses tangles in the welding wire that is supplied to the welding contact electrode. The sensor for tangled wire is comprised of a spring-biased plunger, a combined wire guiding and tension sensing channel located at the end of the plunger, and a plunger guide. The plunger is biased by the spring to a first position, the position for normal operation. When a tangle in the wire occurs at a wire supply spool, an upward force is exerted by the tangled wire on the plunger to overcome the spring bias force on the plunger. As a result, the plunger moves to a second position, the position indicating the presence of tangled wire. The plunger is guided between the first and second plunger positions by a plunger guide.

Once the plunger has moved from the first to the second position, a locking device can retain the plunger in the second position, even when the force from the tangled wire is relaxed.

For sensing an interruption in the supply of welding wire to the welding electrodes, a two-position wire supply continuity sensor is used in conjunction with the two-position tangled wire sensor of the invention. During normal operation of the wire supply, both the tangled wire sensor and the wire continuity sensor are in their positions for normal operation, their first positions. In the first position, the wire continuity sensor senses an interruption in the supply of wire moving past the sensor. The interruptions in the wire supply that are sensed are severed wires and the depletion of the wire supply on a supply coil. When tangled wire sensor is in its normal operating position and when an interruption in the wire supply is sensed, the sensing element in the wire continuity sensor moves to its second position, the position for wire discontinuity.

The sensing element of the continuity sensor is a spring-biased sensing arm biased toward the supply interruption position. The presence of a normal supply of wire overcomes the bias and retains the sensing arm in the normal supply position, the first position. When an interruption in the wire supply occurs, the bias in the sensing element is not overcome by the presence of a wire, and the sensing element moves to the supply interruption position, the second position. In the supply interruption position, the sensing arm of the wire continuity sensor signals the interruption in the wire supply.

When the tangled wire sensor with its wire guiding and tension sensing channel senses a tangle and moves from its first to its second position, the continuous wire that is exerting a counter bias to the sensing arm on the wire continuity sensor is also moved to the second position. When the continuous wire is moved to the second position, it no longer exerts a counter bias on the sensing element of the continuity sensor, and the sensing element moves to the second position, the supply interruption position.

A system for controlling the power at a wire receiving device, such as the electrodes of an arc welder, is provided by combining an apparatus of the invention for sensing an interruption in the wire supply with control devices which control the wire receiving device.

BRIEF DESCRIPTION OF THE DRAWINGS

The foregoing and other objects, features, and advantages of the invention will be apparent from the more specific description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a perspective view of an embodiment of the invention during normal operation;

FIG. 2 shows a partial back view of the embodiment of the invention in FIG. 1 during a depletion of wire supply;

FIG. 3 shows a partial side view of the embodiment of the invention in FIG. 1 during a tangle sensing occurrence;

FIG. 4 is a top view of the embodiment of the invention shown in FIG. 2; and, FIG. 5 is a front view of the embodiment of the invention shown in FIG. 2.

DETAILED DESCRIPTION OF THE DRAWINGS

With reference to FIG. 1, a system for controlling the supply of electric power to a wire receiving apparatus is shown. In the system, a supply mechanism 1 feeds wire 3 through a wire supply sensing apparatus 4 of the invention to wire receiving (i.e. wire utilization) apparatus 5. Supply mechanism 1 is disposed slightly higher than wire supply sensing apparatus 4. In the embodiment of the invention shown in FIG. 1, the wire is being supplied in the normal condition without interruption. In a preferred embodiment, the wire receiving apparatus 5 comprises a wire feeding device (such as drive rollers) and an arc welding apparatus. Preferred wire is welding wire.

The wire supply sensing apparatus 4 in FIG. 1 is comprised of a two-position tangled wire sensor 7 and a two-position wire supply continuity sensor 9. Both sensors 7 and 9 are mounted on a frame 6. In the states shown in FIG. 1 both sensors 7 and 9 are in their respective first positions for normal operation.

The tangled wire sensor 7 is comprised of biasing spring 11; a biased plunger 13; a wire guide and tension sensing aperture or channel 15; and, a plunger guide 17. A vertical support 19 comprising the frame 6 has the plunger guide 17 mounted thereon. Plunger 13, shown oriented essentially vertically as shown in FIGS. 1 and 3, has an arm 13A welded or otherwise affixed to an upper end thereof. A distal end of arm 13A has an aperture therein for engaging a first end of the helical biasing spring 11. A second end of the spring 11 is mounted to frame 6 in the manner hereinafter described.

The supply continuity sensor 9 is a commercially available microswitch which comprises a spring 21; a sensing arm 23; a slip pad 25; and, an electric switch 27. The sensor 9 is mounted by fasteners 28 to an essentially vertically oriented plate 29 which comprises frame 6. Sensor 9 has three terminals on its underside: terminal 30A (a "normally closed" terminal); terminal 30B (a "normally opened" terminal); and, terminal 30C (a "common" terminal).

As shown in FIG. 1, during normal operation when wire 3 is being supplied from the feed mechanism 1 to the wire receiving apparatus 5 without interruption, the spring 11 biases the plunger 13 downwardly in a normal operating position, and the plunger 13 rests on a horizontal platform or shelf HS comprising frame 6. Wire advances from the feed mechanism 1 through the wire guide and tension sensing aperture 15 and over slip pad 25 to the utilization apparatus 5. The slip pad 25 contacts the underside of the moving wire 3, and the force exerted by wire 3 on the sensing arm 23 overcomes the upward bias of spring 21, thereby keeping switch 27 in a normal state. Conductors 31A, 31B, and 31C run from terminals 30A, 30B, and 30C, respectively on switch 27 to a controller 33 which is connected by conductors 35 to wire receiving apparatus 5.

FIG. 2 illustrates the embodiment of the invention shown in FIG. 1 when an interruption in the supply of wire occurs due to depletion of the wire supply. When the wire supply is depleted, the tangled wire sensor 7 remains in the normal operating position. However, without the presence of the wire 3 to overcome the biasing force of spring 21 and thereby keep the sensing arm 23 in the normal position, spring 21 biases sensing arm 23 to a second position, the supply interruption position. When sensing arm 23 reaches the second position, switch 27 is switched from the normal state, and a supply interruption signal is sent along an appropriate conductor 31 to controller 33. Controller 33 is connected to the wire utilization apparatus 5 by conductors 35 (see FIG. 1), and controller 33 turns off the power to utilization apparatus 5.

In an unillustrated alternate embodiment, switch 27 is in series with the power supply to wire receiving apparatus 5, and movement of sensing arm 23 to the second position directly interrupts power to the wire receiving apparatus 5.

FIG. 3 illustrates the embodiment of the invention shown in FIG. 1 when the tension in wire 3 is increased by virtue of a tangle on the supply spool. As a result of the tangle, and the slightly higher location of wire supply mechanism 1 with respect to aperture 15, a force caused by the tension in wire 3 overcomes the bias force of spring 11 and moves the tension sensing aperture 15 and the plunger 13 upwardly to a second position, the tangle sensing position. In the tangle sensing position, the wire 3 has been raised along with the aperture 15 and plunger 13 so that the wire 3 no longer opposes the biasing force of the spring 21 of the continuity sensor 9. As a result, the spring 21 raises the sensing arm 23 to the second position, the supply interruption position, and switch 27 is switched from the normal state to the supply interruption state. The supply interruption is signalled along conductor 31B to controller 33 which effectively turns off the receiving apparatus 5 as described above.

In FIG. 3 a locking mechanism is shown for locking the plunger 13 in the tangle sensing position even after the force that caused the tangle 37 to move the plunger 13 to the tangle sensing position is relaxed. The locking mechanism comprises a notch 45 near the bottom of the plunger 13 and a resilient projection in the form of a leaf spring 47 which is biased against the plunger 13. When the plunger 13 is in the tangle sensing position, leaf spring 47 engages notch 45 and prevents plunger 31 from returning to the normal operating position (i.e. the position of normal wire supply). The positions of leaf 47 and notch 45 during normal wire supply conditions are shown in FIG. 1.

As shown in FIG. 1, controller 33 is connected to the wire supply mechanism 1 by conductors 40. In this embodiment, when controller 33 receives a supply interruption signal from switch 27, controller 33 can then turn off power to both the wire receiving apparatus 5 and the wire supply mechanism 1.

As shown in FIGS. 2 and 4, the vertical support 19 (upon which the plunger 13 and spring 11 are ultimately mounted) and the horizontal plate 29 (upon which the wire continuity sensor 9 is mounted) are in fixed relation to each other and are adjustable vertically with respect to a common vertical support 42. The common vertical supply member 42 is sandwiched between the vertical support 19 and the horizontal plate 29. Bolts 51 pass through holes in supports 19 and 29 and through vertical slots 55 in support 42. When nuts 53 are loosened on bolts 51, the supports 19 and 29 are movable as a unit vertically on support 42. The slots 55 guide the supports 19 and 29 vertically. When a desired vertical location is selected, nuts 53 are tightened on bolts 51.

Vertical slots 57 are provided on horizontal support 29. Fasteners 28 pass through the body of switch 27 and through the slots 57 in horizontal plate 29. By loosening nuts 61 on fasteners 28, the angular orientation of switch 27 can be adjusted with respect to horizontal support 29.

The second or lower end of the helical spring 11 is mounted by a threaded fastener 71 to a horizontal shelf HS integral with the lower end of support 19. The upper end of fastener 71 has an aperture therein which receives the lower end of spring 11. A nut 75 is counterthreaded with respect to fastener 71 and bears against shelf HS to fix fastener 71 in place. Nut 75 also sandwiches a horizontal portion of a leaf spring 47 between shelf HS and nut 75, thereby giving both springs 11 and 47 a common point of affixation on frame 6. In this regard, the horizontal portion of spring 47 has an aperture drilled or otherwise formed therein to receive the fastener 71.

Although the embodiment discussed above relates to the feeding of wire to an arc welding apparatus, it is apparent that the subject invention can be applied to virtually any apparatus in which a steady supply of wire is important. Such other areas of application may include cable laying.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. An apparatus for sensing either an increase in tension, or the complete absence of, a wire moving from a wire supply device to a wire utilization device, said apparatus comprising:

frame means;

a switch for turning off a wire utilization device, said switch being mounted on said frame means and responsive to the absence of wire normally moving in contact therewith;

plunger means adapted to move axially in a single plane between a first normal operating position and a second position in response to an increase in tension of said wire;

plunger guide means mounted to said frame means for guiding the movement of said plunger means from said normal operating position to said second position;

spring biasing means for exerting a force to bias said plunger means toward said normal operating position;

sensing means integrally mounted on said plunger means and cooperating with said wire for sensing an increase in tension of the said wire, said sensing means being adapted to move said plunger means against said spring biasing means when the tension in said wire overcomes the biasing force exerted by said spring biasing means to thereby move said plunger means to said second position, whereby said wire is moved by said plunger means out of contact with said switch thereby allowing said switch to move to a wire interruption position and to thereby turn off said wire utilization device.

2. An apparatus as described in claim 1, further comprising:

locking means for locking said plunger means in said sensed tangle position when a tangle in the wire is sensed.

3. An apparatus as described in claim 2, wherein said sensing means is connected to a first end of said plunger means, and wherein said locking means comprises:

a notch formed proximate a second end of said plunger means; and, projection means mounted to said frame, said resilient projection means being adapted to engage said notch when said plunger means is moved to said sensed tangle position, whereby said engagement of said notch and said resilient projection means locks said plunger means in said sensed tangle position.

4. An apparatus as described in claim 3, further comprising:

mounting means whereby said biasing means and said resilient projection means are mounted at the same point to said frame means.

5. An apparatus as described in claim 1, wherein:

the wire is welding wire; and, the wire receiving device is an electric arcwelding apparatus.

6. An apparatus as described in claim 1, wherein said sensing means comprises an aperture formed in said plunger means, said aperture being sized to receive wire as the wire moves from said wire supply to said wire receiving device.

7. A method for sensing an irregular condition in a wire being fed from a wire supply to a wire utilization device, said method comprising the steps of:

directing wire from said wire supply to tangle sensing means, said tangle sensing means being associated with plunger means;

exerting a spring biasing force on said plunger means whereby said plunger means is maintained in a plunger first position;

using said sensing means to sense tension indicating a tangle in said wire, said tangle sensing means being adapted to sense when the tension in said wire being fed from said wire supply overcomes the force exerted by said biasing means and being adapted to move said plunger means axially in a single plane to a plunger second position in response to such tension;

directing wire from said tangle sensing means to wire interruption sensor means in a manner whereby (1) when said plunger means is in said plunger first position, said wire maintains said interruption sensor means in a sensor first position, and whereby (2) when said plunger means is moved to said plunger second position, said interruption sensor means is moved to a sensor second position; and, turning off said wire utilization device when said interruption sensor means moves to said sensor second position.

8. The method of claim 7, wherein said step of directing said wire from said wire supply to said tangle sensing means comprises directing said wire through an aperture in said plunger means, said aperture being sized to receive wire as the wire moves from said wire supply to said wire utilization device.

9. The method of claim 7, comprising the further step of:

locking said plunger means in said second position when said wire guiding means senses a tangle in said wire.

* * * * *